US006893384B2

(12) United States Patent
Triani

(10) Patent No.: US 6,893,384 B2
(45) Date of Patent: May 17, 2005

(54) KICK BOXING TRAINING BAG WITH FLEXIBLE AND DISMOUNTABLE SUPPORTING STRUCTURE

(75) Inventor: Aldo Triani, Fidenza (IT)

(73) Assignee: Real Globe s.r.l. (IT)

( * ) Notice: Subject to any disclaimer, the term of this patent is extended or adjusted under 35 U.S.C. 154(b) by 0 days.

(21) Appl. No.: 10/479,792

(22) PCT Filed: Jun. 7, 2001

(86) PCT No.: PCT/IT01/00293

§ 371 (c)(1),
(2), (4) Date: Dec. 5, 2003

(87) PCT Pub. No.: WO02/098520

PCT Pub. Date: Dec. 12, 2003

(65) Prior Publication Data

US 2004/0152568 A1 Aug. 5, 2004

(51) Int. Cl.[7] ..... A63B 64/20
(52) U.S. Cl. ..... 482/83; 482/87; 482/90
(58) Field of Search ..... 482/83–90; 472/441–445

(56) References Cited

U.S. PATENT DOCUMENTS 1,099,417 A * 6/1914 Armstrong
2,085,161 A * 6/1937 Kraus
2,197,545 A * 4/1940 Bachman et al.
5,330,403 A 7/1994 Kuo
5,697,870 A * 12/1997 Osborn ..... 482/52
5,941,801 A * 8/1999 D'Alto ..... 482/90
6,183,399 B1 * 2/2001 Chen ..... 482/90

FOREIGN PATENT DOCUMENTS

| | | |
|---|---|---|
| AU | 631 773 B | 11/1992 |
| EP | 1 095 674 A2 | 5/2001 |
| GB | 318 719 A | 9/1929 |
| WO | WO 91/01779 | 2/1991 |

* cited by examiner

*Primary Examiner*—Jerome W. Donnelly
(74) *Attorney, Agent, or Firm*—Muserlian, Lucas and Mercanti, LLP

(57) ABSTRACT

A kick boxing training bag includes a foam rubber padding (17) slipped onto a supporting structure provided with a hollow base (3) which can be filled with ballast, the supporting structure including two hollow cylindrical rubber springs (9, 13) connected by a rigid rod (11). The elastically flexible structure prevents any trauma to the athlete, provides greater realism of the training which can be much faster and rhythmic, can take even very strong blows without risking the fall of the bag and allows to easily make devices with different elastic responses according to the needs by changing the flexibility of the springs. Moreover, the base (3) is separable and stackable to facilitate the storage of a plurality of bags.

13 Claims, 6 Drawing Sheets

KICK BOXING TRAINING BAG WITH FLEXIBLE AND DISMOUNTABLE SUPPORTING STRUCTURE

This patent application claims the benefit of priority from PCT application Ser. No. PCT/IT01/00293 filed Jun. 07, 2001, the contents of which are incorporated herein by reference.

The present invention relates to kick boxe training devices, and in particular to a training bag provided with a flexible and dismountable supporting structure.

It is known that in kick boxe blows are brought not only with the fists but also with feet and knees, whereby the power with which the training bag is hit may be greater than that usually found in conventional boxe. However, the training devices presently available do not take into account such a difference between these two types of boxe and are substantially similar to conventional long hanging bags in use since long ago.

In practice, a prior art bag simply consists of a foam rubber padding slipped from above onto a rigid supporting base, which has a hollow structure to be filled with ballast material (e.g. water, sand). This base is usually shaped as a circular cylinder, with a larger diameter in the lower portion and a smaller diameter in the upper portion on which the padding is slipped. Such a simple structure though being advantageously cheap however has several drawbacks which make its use quite problematic.

A first group of drawbacks stems from the rigidity of the structure, whereby the athlete must necessarily wear protective items (gloves, shoes, etc.), and despite that still undergoes microtraumas. Moreover, the athlete is being trained with a device which is unrealistic, in that an opponent in a fight certainly does not take the blows without moving a bit. Furthermore, if the device is hit too strongly it may fall and increasing the ballast to prevent its fall would make it extremely difficult to be moved.

A second type of drawback stems from the integral structure which makes it bulky and difficult to handle. In fact, when you need to store a plurality of prior art devices it is required to have an adequate room, in that they can not be stacked and are too heavy to be raised and hung on a wall.

Still another drawback comes from the fact that the cylindrical base is dangerous in case a kick is brought too low with respect to the position of the foam rubber padding. In fact it may happen that the athlete hits the base by mistake bumping against a rigid vertical wall which can cause a serious trauma to the foot.

Therefore the object of the present invention is to provide a device which is free from the above-mentioned drawbacks. This object is achieved by means of a training bag whose supporting structure includes at least two flexible members. Other advantageous features of the present device are disclosed in the dependent claims.

A first fundamental advantage of the present device is that of preventing any trauma to the athlete, who can even do without the protective items.

Another advantage stemming from the flexibility of the structure is the greater realism of the training which can be much faster and rhythmic. Moreover the flexible structure can take even very strong blows without risking the fall of the device, thanks to the effect of energy dissipation due to the internal friction between the elements of the device.

Still another advantage of such a flexible structure is that it is easy to make devices with different elastic response according to the needs. For example, it is possible to calculate the flexibility according to the power of the athlete to have models for man, woman and child.

A further advantage of the present device in its preferred embodiment is that of allowing the separation of the ballasted base from the light upper portion. In this way it is possible to stack the bases, properly shaped, and to house in wall racks the upper portions so as to store several devices in a very small space.

Also the fact of having a conical base provided with a protective cover results in the advantage of preventing traumas to the athlete's foot in the case of a low kick, since the padded and inclined plane deadens the blow and deviates it upward in the direction of the real bag.

Further advantages and characteristics of the training bag according to the present invention will be clear to those skilled in the art from the following detailed description of an embodiment thereof, with reference to the annexed drawings wherein.

Figure 2:
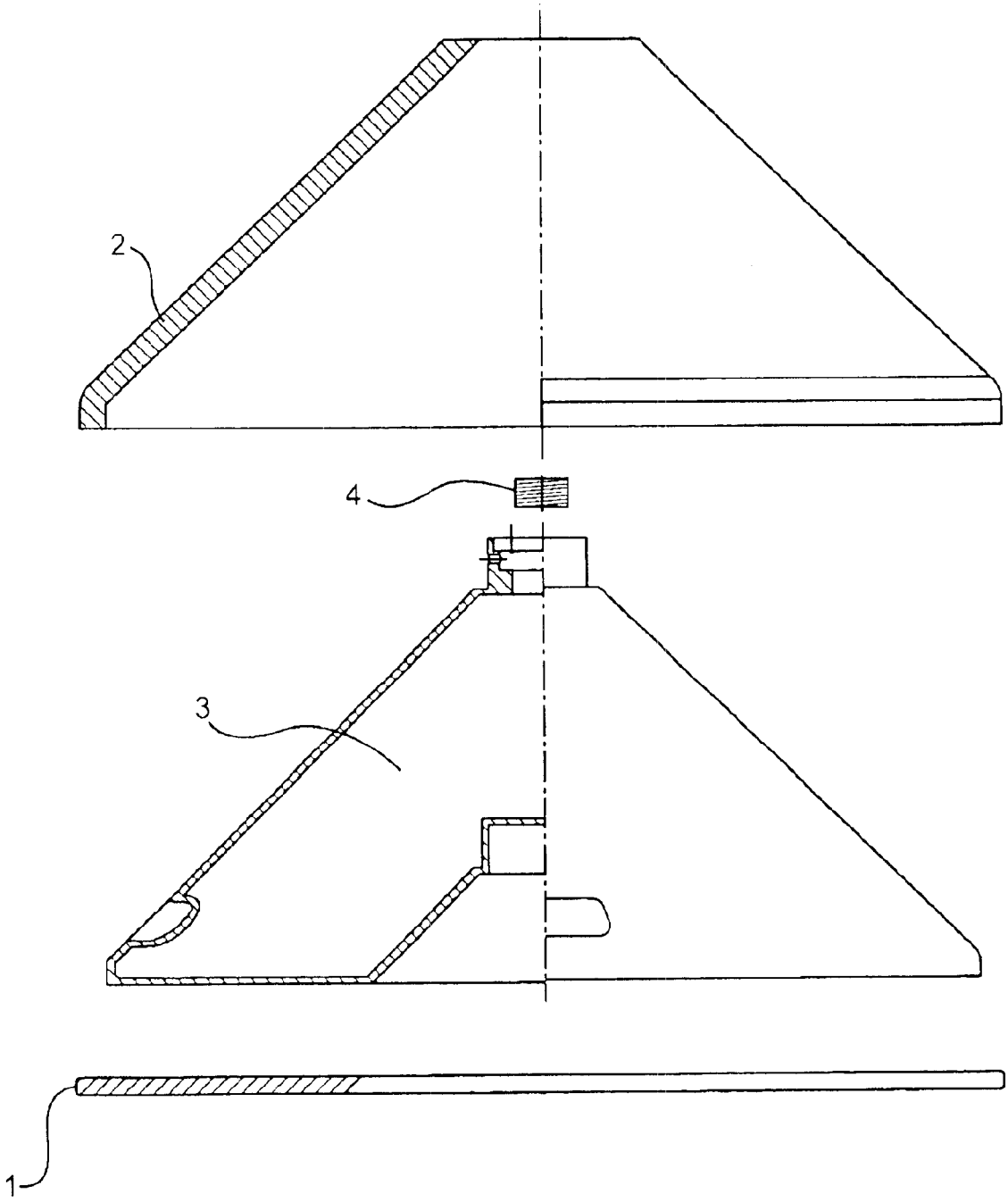
FIG. 2 is a semisectional vertical view of the elements which make up the device base.

With reference to said figures, and in particular to FIG. 2, there is seen that the base of the present device consists of a hollow conical structure 3 externally covered by a padding 2 and with an antislip mat 1 glued to its bottom. The base is closed by a disappearing top plug 4, i.e. a plug provided with an external thread and a polygonal socket for driving it into a corresponding threaded bore at the vertex of the cone.

Figure 6:
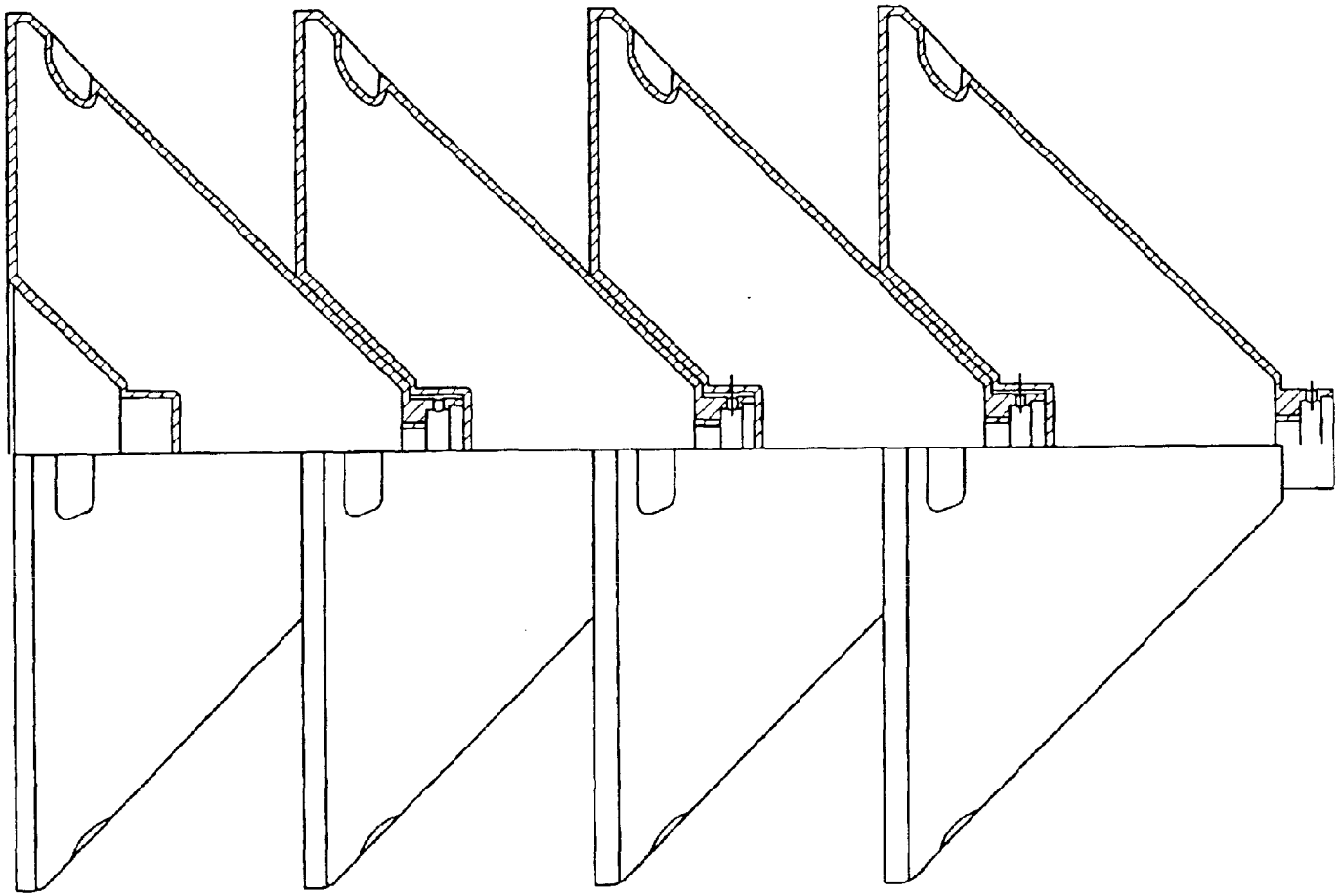
FIG. 6 is a semisectional vertical view showing how the bases can be stacked for storage.

To facilitate the stacking of the bases, illustrated in FIG. 6, structure 3 has recesses which make it easier to grab it for raising and the bottom side of the hollow structure 3 is shaped with a concave profile mating with the top portion of the structure itself. Furthermore mat 1 has a central hole at that profile.

Figure 1:
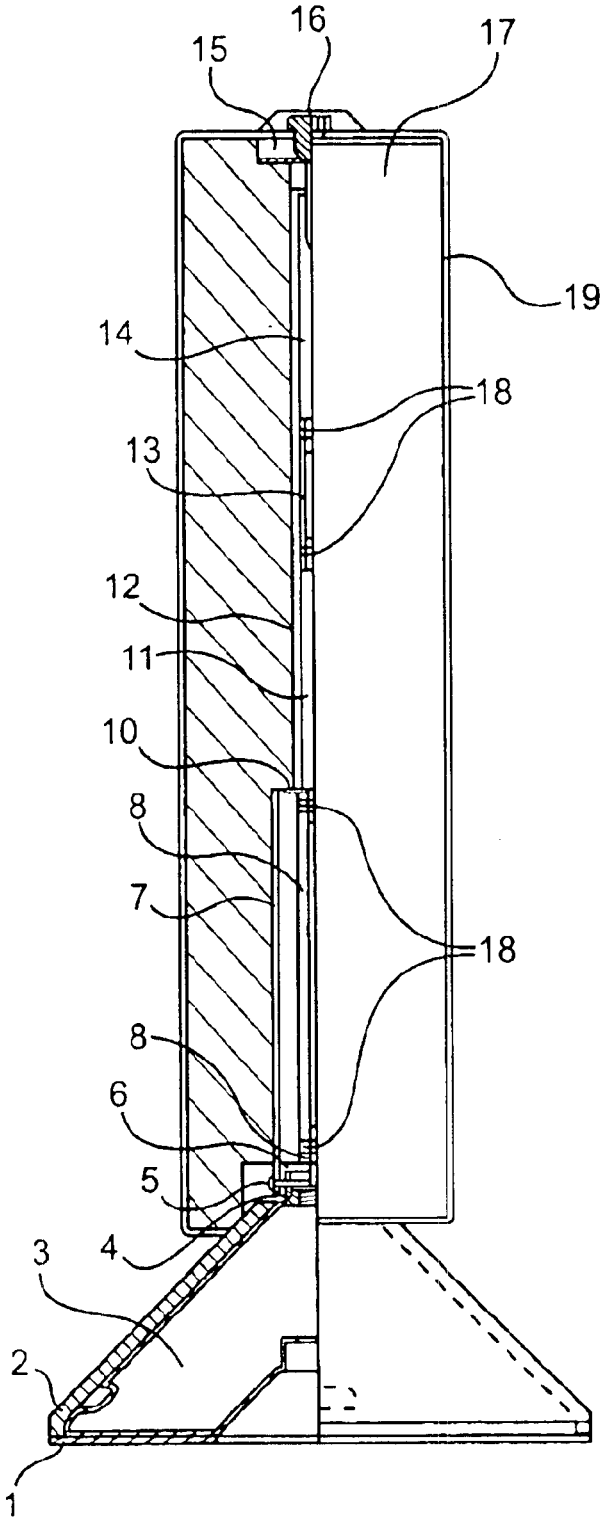
FIG. 1 is a semisectional vertical view of a device according to the invention.
Figure 3:
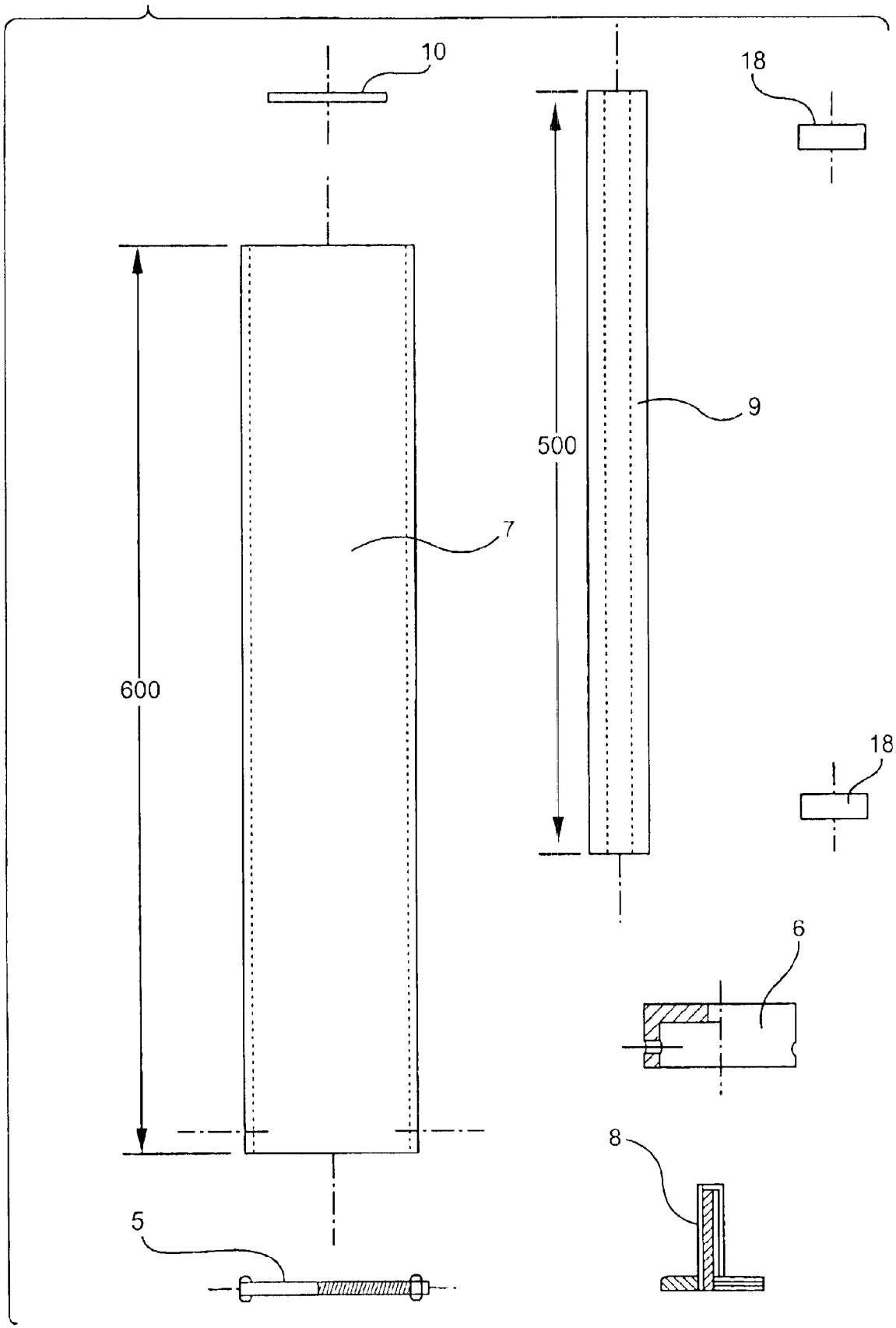
FIG. 3 is a view of the elements for the connection to the base and the support in the lower portion of the device.

In FIG. 3 there are illustrated the elements for removably connecting to the base the internal structure which holds the foam rubber padding. Said connection is achieved by means of a threaded stud 8 shaped as an inverted T on which there is slipped a small cylinder 6 open at the bottom, provided with a central vertical hole for the passage of stud 8 and with a horizontal hole for the passage of a bolt 5. In practice, as shown in FIG. 1, the small cylinder 6 with stud 8 therein is slipped onto the top of the conical base 3 where, above plug 4, there is formed a horizontal hole corresponding to the hole in cylinder 6 which is thus blocked through bolt 5. In this way, stud 8 is enclosed between bolt 5 and cylinder 6 and the latter is restrained to the base.

On stud 8 projecting through cylinder 6 there is secured a first hollow cylindrical rubber spring 9 which, in the illustrated example, is 500 mm high and has a wall 13 mm thick. The securing of spring 9 onto stud 8 is achieved by means of a hose clip 18, and spring 9 is also protected by a tube 7 of rubber and steel. More specifically, tube 7 has a wall 4 mm thick and extends in height for 600 mm completely covering spring 9 and cylinder 6, in fact it is provided at the bottom end with a horizontal hole for the passage of bolt 5.

It should be noted that tube 7 has an inner diameter much larger than the outer diameter of spring 9 so as to leave a wide play between said two members. Moreover, at the top of tube 7 there is inserted a ring 10 which has the function of preventing the crushing of the tube.

Through this ring 10 there is introduced into the top of spring 9 the bottom end of an intermediate rigid rod 11, also in this case secured by means of a hose clip 18. The top end of rod 11, illustrated in FIG. 4, in introduced into a second hollow cylindrical rubber spring 13 which in the illustrated example is 200 mm high and has a wall 9,5 mm thick so as to have a greater flexibility with respect to the lower spring 9.

Into the top of spring 13 there is introduced the bottom end of an upper rigid rod 14, and also in this case the securing of the two rods 11 and 14 into spring 13 is achieved by means of hose clips 18. Moreover, same as in the lower portion of the device, also here there is provided a protective tube 12 of rubber and steel which has a wall 4 mm thick and extends in height for 800 mm completely covering spring 13 and the two rods 11 and 14 connected thereto.

Since tube 12 is much smaller in diameter than tube 7 it does not require an anti-crushing ring, yet it still has some mm of play with respect to the elements enclosed therein.

Figure 5:
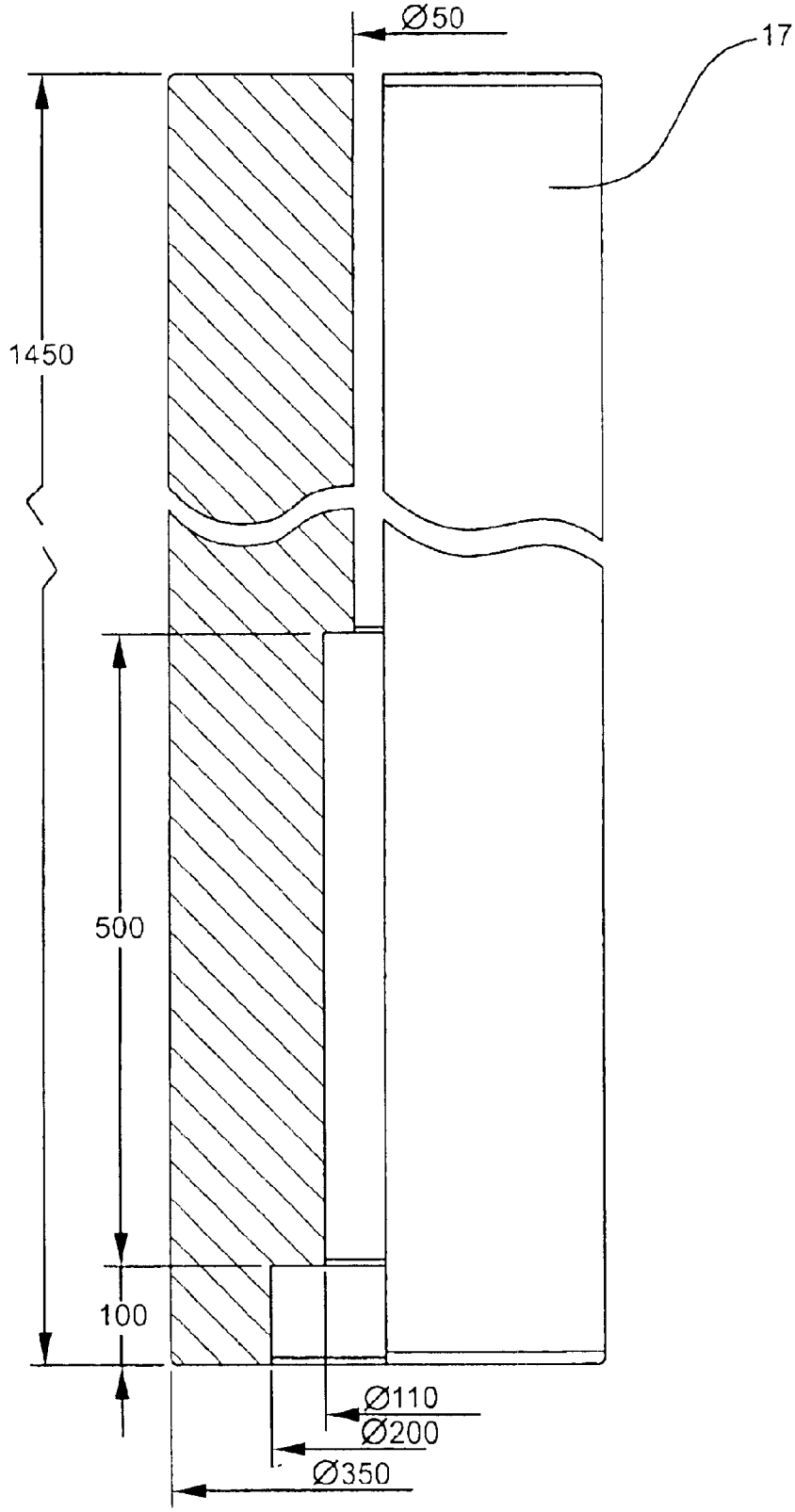
FIG. 5 is a semisectional vertical view of the foam rubber padding which is slipped onto the supporting structure.

After the group of springs 9 and 13 with rods 11 and 14 has been assembled and covered by tubes 7 and 12, on this supporting structure there is slipped the bag 17 of foam rubber (density 30%) whose inner profile is illustrated in the semisectional view of FIG. 5.

In particular, bag 17 has a central cavity extending for 100 mm with a diameter of 200 mm to completely cover the area of connection to the base, so as to abut on the side of the conical base without interruption of the padding. The cavity of bag 17 then narrows to a diameter of 110 mm for a height of 500 mm, said diameter corresponding to the outer diameter of the lower tube 7, and finally to a diameter of 50 mm for a height of 850 mm, said diameter corresponding to the outer diameter of the upper tube 12.

Figure 4:
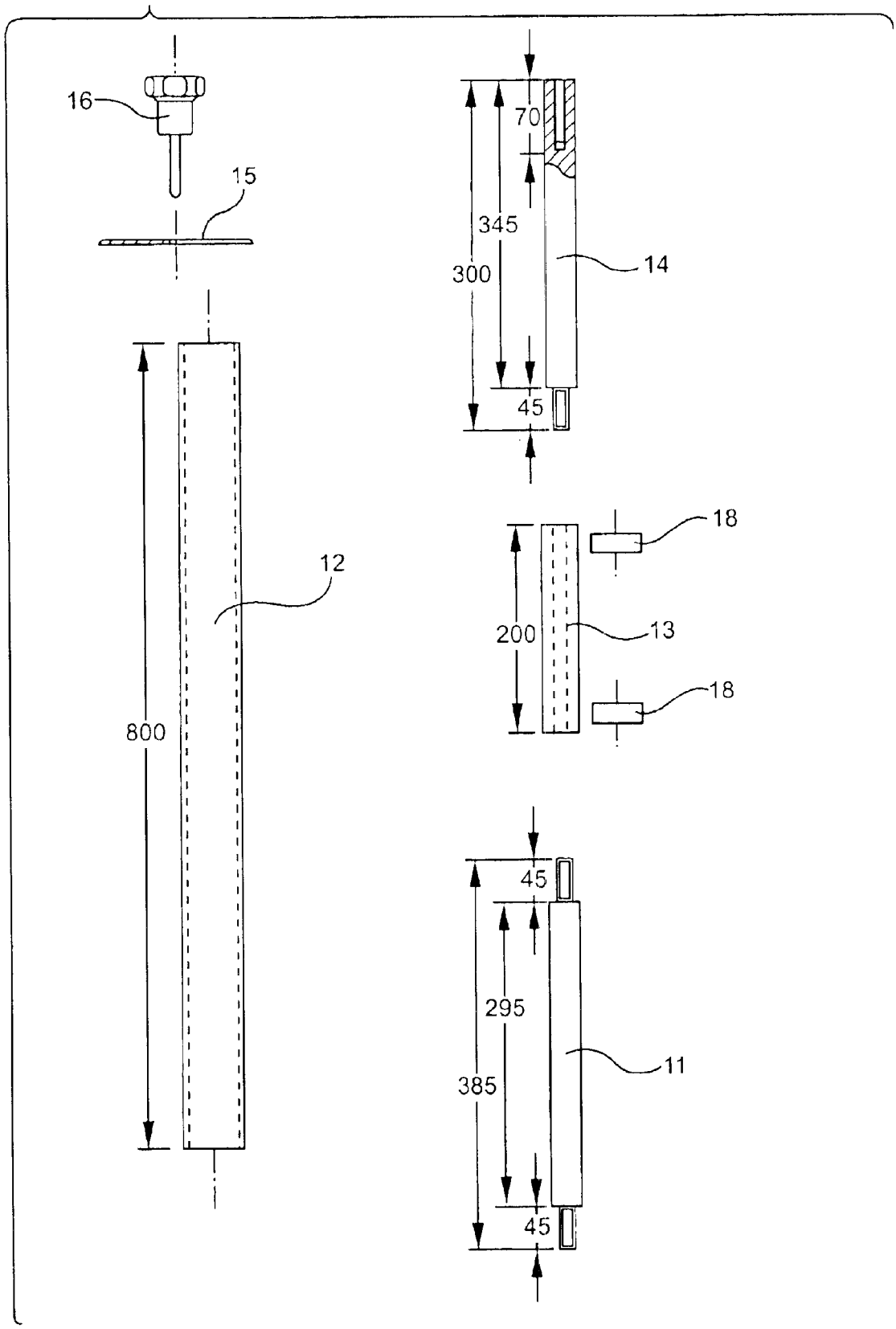
FIG. 4 is a view of the elements for the support in the upper portion and the locking at the top of the device.

Once bag 17 has been placed on the supporting structure, its locking is achieved through a retaining disk 15 tightened by means of a retaining knob 16 provided with a threaded pin which is screwed into a seat formed at the top of the upper rod 14 (FIG. 4). Finally, the bag is covered by an external protective cover 19 which may also cover knob 16 (FIG. 1) or leave it accessible.

From the above description of the present device it is clear how it achieves all the intended objects. In fact the presence of the two springs 9 and 13 provides the necessary flexibility to the supporting structure, which responds elastically to the athlete's blows without risks of device fall and with the possibility of changing the response by simply changing the above-mentioned springs.

Furthermore the dismounting and storing of the device are quite simple, in fact it is sufficient to unscrew knob 16 and raise bag 17 until access is gained to bolt 5 to be removed and all the upper portion of the device is separated from the ballasted base. At this point the light portion can be easily stored in various ways, while the conical bases 3 can be stacked one on top of the other, upon removal of the padding 2 which being made of a soft material can be folded for storage.

It is clear that the above-described and illustrated embodiment of the device according to the invention is just an example susceptible of various modifications. In particular, the exact shape and size of the elements making up the supporting structure may be changed according to specific needs, for example by changing the height and/or thickness of springs 9 and 13 which may also be of other kind, such as metal coil springs. Similarly, the securing means for assembling the various elements may be replaced with other mechanically equivalent means, for example replacing clips 18 with metallic threaded inserts enclosed in the rubber of the springs for the connection to the rods and to the base stud.

What is claimed is:

1. Kick boxing training bag including a foam rubber padding (17) slipped onto a supporting structure provided with a hollow base (3) which can be filled with ballast, characterized in that said supporting structure includes at least two elastically flexible members (9, 13) connected by at least a rigid member (11) protective tube's (7, 12) of rubber and steel arranged between the supporting structure and the foam rubber padding (17), said protective tubes (7, 12) being sized so as have no play with respect to said padding (17) and a significant play with respect to the supporting structure.

2. Kick boxing bag according to claim 1, characterized in that the upper elastic member (13) has a flexibility greater than the lower elastic member (9).

3. Kick boxing bag according to claim 1, characterized in that said elastic members (9, 13) are hollow cylindrical rubber springs.

4. Kick boxing training bag according to claim 1, characterized in that the lower elastic member (9) is 500 mm high, the rigid connecting member (11) is 300 mm high and upper elastic member (13) is 200 mm high.

5. Kick boxing training bag according to claim 1, characterized in that the locking of the padding (17) onto the supporting structure is achieved through a top retaining disk (15) tightened by means of a retaining knob (16) provided with a threaded pin which is screwed into a seat formed at the top of an upper rigid member (14) connected to the upper flexible member (13).

6. Kick boxing training bag according to claim 1, characterized in that the securing between the rigid members (11, 14) and the flexible members (9, 13) is achieved by means of end pins of the rigid members which are introduced into cavities of the flexible members and locked therein by external hose clips (18).

7. Kick boxing training bag according to claim 1, characterized in that it includes means for removably connecting the hollow base (3) to the structure supporting the foam rubber padding (17).

8. Kick boxing training bag according to claim 7, characterized in that said connecting means consist of a threaded stud (8) shaped as an inverted T on which there is slipped a small cylinder (6) provided with a central vertical hole for the passage of said stud (8) and with a horizontal hole for the passage of a bolt (5), said small cylinder (6) with the stud (8) therein being slipped onto the top of the hollow base (3) where there is formed a horizontal hole corresponding to the hole in the small cylinder (6).

9. Kick boxing training bag according to claim 1, characterized in that the hollow base (3) has a conical shape.

10. Kick boxing training bag according to claim 1, characterized in that the hollow base (3) is covered by a padding (2).

11. Kick boxing training bag according to claim 1, characterized in that the hollow base (3) has on its bottom side a concave profile mating with the top profile of the base itself.

12. Kick boxing training bag according to claim 1, characterized in that the hollow base (3) is closed by a top plug (4) provided with an external thread and a polygonal socket for driving it into a corresponding threaded bore.

13. Kick boxing training bag according to claim 1, characterized in that the hollow base (3) is provided with lateral recesses which make it easier to grab it for raising.

* * * * *